US012195890B2

(12) United States Patent
Durrell et al.

(10) Patent No.: US 12,195,890 B2
(45) Date of Patent: Jan. 14, 2025

(54) KNITTED COMPONENT WITH AN ANGLED RAISED STRUCTURE

(71) Applicant: NIKE, Inc., Beaverton, OR (US)

(72) Inventors: Dalton T. Durrell, Portland, OR (US); Weibing Gong, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

(21) Appl. No.: 17/951,574

(22) Filed: Sep. 23, 2022

(65) Prior Publication Data

US 2023/0013080 A1 Jan. 19, 2023

Related U.S. Application Data

(63) Continuation of application No. 16/519,313, filed on Jul. 23, 2019, now Pat. No. 11,466,387.

(60) Provisional application No. 62/702,192, filed on Jul. 23, 2018.

(51) Int. Cl.

| | |
|---|---|
| ***D04B 1/22*** | (2006.01) |
| ***A43B 1/04*** | (2022.01) |
| ***A43B 23/02*** | (2006.01) |

(52) U.S. Cl.

CPC ..... *D04B 1/22* (2013.01); *A43B 1/04* (2013.01); *A43B 23/0205* (2013.01); *D10B 2501/043* (2013.01)

(58) Field of Classification Search

CPC ... D04B 1/22; D04B 1/24; D04B 1/10; D04B 1/102; A43B 1/04; A43B 23/0245

See application file for complete search history.

(56) References Cited

U.S. PATENT DOCUMENTS

| | | | |
|---|---|---|---|
| 8,522,577 | B2 | 9/2013 | Huffa |
| 9,078,488 | B1 | 7/2015 | Meir et al. |
| 9,637,847 | B2 | 5/2017 | Terai et al. |
| 9,668,533 | B2 | 6/2017 | Dua et al. |
| 10,895,025 | B2 | 1/2021 | Manos-gully et al. |
| 11,166,516 | B2 | 11/2021 | Fraser et al. |
| 11,214,897 | B2 | 1/2022 | Berrian et al. |
| 2010/0154256 | A1 | 6/2010 | Dua |

(Continued)

FOREIGN PATENT DOCUMENTS

| | | | |
|---|---|---|---|
| CN | 102056502 | A | 5/2011 |
| JP | S60181351 | A | 9/1985 |

(Continued)

OTHER PUBLICATIONS

Intention to Grant received for European Patent Application No. 19749950.2, mailed on Jan. 3, 2023, 7 pages.

(Continued)

*Primary Examiner* — Danny Worrell

(74) *Attorney, Agent, or Firm* — Shook, Hardy & Bacon L.L.P.

(57) ABSTRACT

A knitted component may include a base portion formed with a plurality of courses extending generally in a course-wise direction of the knitted component. A tubular knit structure of the knitted component may form a raised structure located on a first side of the base portion, where the raised structure includes a plurality of uninterrupted consecutive loops of a first course. The first course of the raised structure may be angled at least 5 degrees relative to the course-wise direction of the knitted component.

20 Claims, 6 Drawing Sheets

(56) References Cited

U.S. PATENT DOCUMENTS

| | | | | |
|---|---|---|---|---|
| 2013/0239438 | A1 | 9/2013 | Shaffer et al. | |
| 2018/0042333 | A1* | 2/2018 | Manos-Gully ..... | A43B 1/04 |
| 2020/0022447 | A1 | 1/2020 | Durrell et al. | |

FOREIGN PATENT DOCUMENTS

| | | | |
|---|---|---|---|
| WO | 2014/134682 | A1 | 9/2014 |
| WO | 2016/053805 | A1 | 4/2016 |

OTHER PUBLICATIONS

Extended European Search Report received for European Patent Application No. 23175658.6, mailed on Aug. 30, 2023, 9 pages.

* cited by examiner

KNITTED COMPONENT WITH AN ANGLED RAISED STRUCTURE

CROSS-REFERENCE TO RELATED APPLICATIONS

This non-provisional patent application is a continuation of co-pending U.S. patent application Ser. No. 16/519,313, filed on Jul. 23, 2019, and titled "Knitted Component with an Angled Raised Structure," which claims priority to U.S. provisional app. No. 62/702,192, filed Jul. 23, 2018, and titled "Knitted Component with an Angled Raised Structure," both of which are herein incorporated by reference in their entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines.

In some articles, it may be desirable to include a raised structure via a tubular knit structure. Typically, tubular knit structures extend along a course-wise direction of a knitted component. The present disclosure describes knitting techniques and structures for including an angled raised structure.

BRIEF DESCRIPTION OF THE DRAWINGS

The embodiments will be further described in connection with the attached drawings. It is intended that the drawings included as a part of this specification be illustrative of the exemplary embodiments and should in no way be considered as a limitation on the scope of the present disclosure. Indeed, the present disclosure specifically contemplates other embodiments not illustrated but intended to be included in the claims.

DETAILED DESCRIPTION

Figure 1:
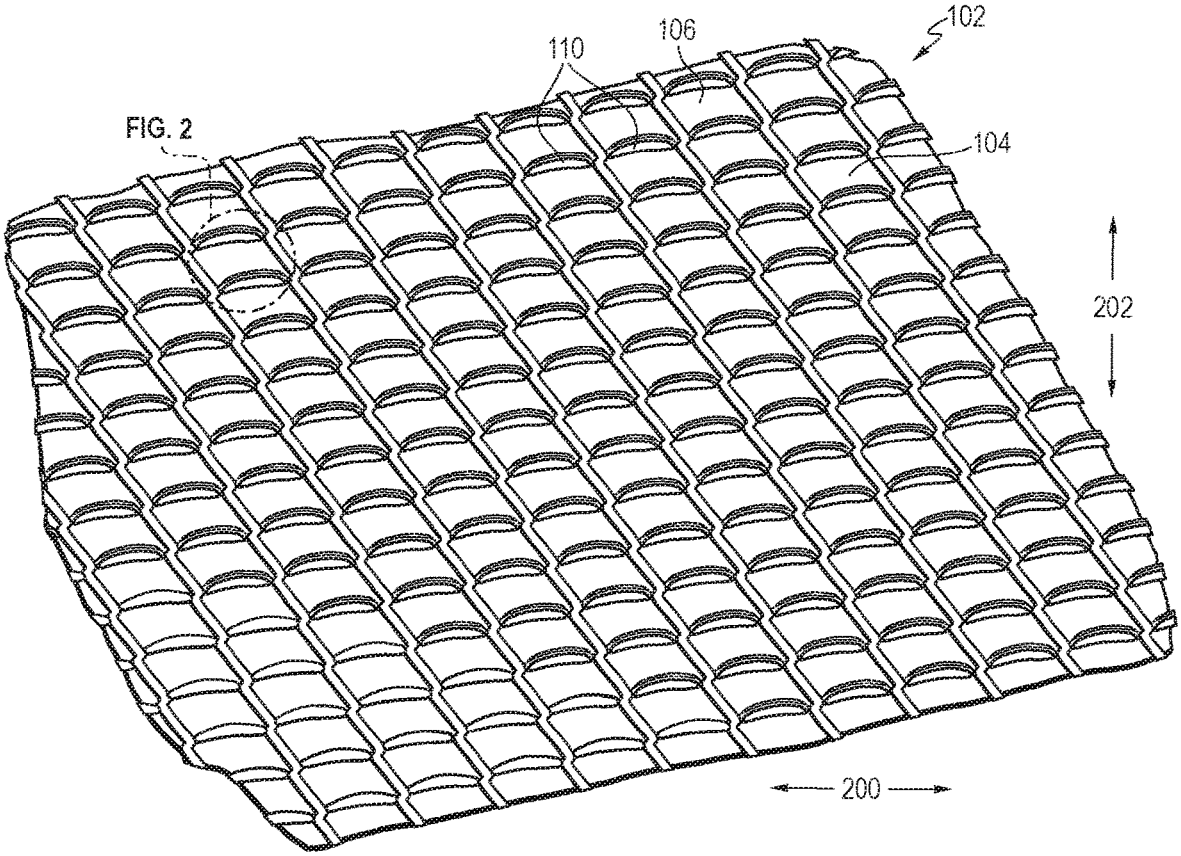
FIG. 1 is an illustration showing a front view of a knitted component with an angled raised structure in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

In some aspects, the present disclosure relates to a knitted component. The knitted component may include a base portion formed with a plurality of courses extending generally in a course-wise direction of the knitted component and a tubular knit structure forming a raised structure located on a first side of the base portion, where the raised structure includes a plurality of uninterrupted consecutive loops of a first course. The first course of the raised structure may be angled at least 5 degrees relative to the course-wise direction of the knitted component.

Optionally, the raised structure further includes a second course and a third course, where the first course is interlooped with the second course, and where the second course is interlooped with the third course. A first loop may couple a first end of the raised structure to the base portion of the knitted component, where a second loop couples a second end of the raised structure to the base portion, and where the first loop and the second loop are offset in a wale-wise direction, the wale-wise direction being perpendicular to the course-wise direction. At least one of the first loop and the second loop may be formed with at least one yarn having a tenacity greater than about 5 g/D.

In some embodiments, a margin extending along a longitudinal edge of the raised structure may be included, where the margin is formed with a yarn having a tenacity greater than about 5 g/D. The margin may have a color that is different than a color of the raised structure.

The raised structure may be elevated at least 3 mm with respect to the base portion of the knitted component. The raised structure may have a length of at least 5 mm.

Optionally, the base portion includes a plurality of courses extending generally in the course-wise direction such that the plurality of courses of the base portion are angled relative to the raised structure.

Another aspect of the present disclosure relates to a method for forming a knitted component. The method may include knitting a tubular knit structure to form a raised structure on a base portion of a knitted component, securing the tubular knit structure a first loop and a second loop, interlooping the first loop to a base portion of the knitted component at a first location, holding the second loop on a needle bed of a knitting machine while knitting at least two courses of the base portion with the knitting machine, and interlooping the second loop to the base portion of the knitted component at a second location. The first location and the second location may be offset in a wale-wise direction such that the raised structure is angled.

Figure 2:
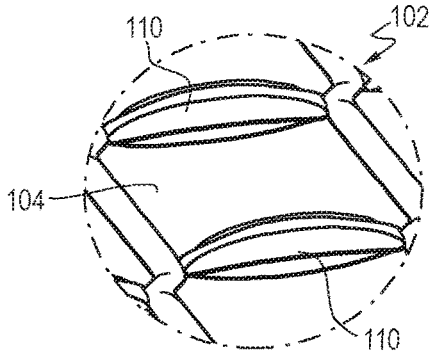
FIG. 2 is an illustration showing a magnified view of a portion of the knitted component of FIG. 1.

FIG. 1 is an illustration showing a front view (e.g., a first side) of a knitted component 102 that may be used in any of the examples above (e.g., an upper for an article of footwear or an article of apparel). FIG. 2 is a magnified view of a portion of the knitted component 102 of FIG. 1. Referring to FIGS. 1-2, a base portion 104 of the knitted component 102 may be formed with a plurality of courses extending generally in a course-wise direction 200 of the knitted component. The course-wise direction 200 is defined by the direction that a feeder moves on a knitting machine when forming courses of the knitted component on a needle bed (e.g., as described in U.S. Pat. No. 8,522,577, filed on Mar. 15, 2011 as U.S. patent application Ser. No. 13/048,527, which is hereby incorporated by reference in its entirety). The course-wise direction 200 of the knitted component 102 is apparent to those skilled in the art upon viewing the structure of the knitted component 102, since the course-wise direction 200 is the direction that the majority of the courses of the knitted component 102 generally follow (at any given location). In some examples the course-wise direction 200 may change along the knitted component 102 (e.g., when the knitted component 102 has a curved feature) when the knitted component 102 is in a resting state, but the course-wise direction 200 is constant during manufacturing (e.g., corresponding to the needle bed of the knitting machine). Similarly, a wale-wise direction 202, which is defined as the direction perpendicular to the course-wise direction 200, generally follows the direction of the majority of the wales of the knitted component 102.

Optionally, the knitted component 102 may include one or more raised structures 110 that extend from the first side 106 of the base portion 104. A second side of the base portion 104, which is located on the opposite side of the textile (and thus not visible in FIGS. 1-2), may additionally or alternatively include raised structures. The raised structures may be formed generally of tubular knit structures known to form "ottomans" or "welts" on a fabric by knitting a series of consecutive courses (each having a plurality of uninterrupted consecutive loops) on a single needle bed of a knitting machine and then locking those courses to a second needle bed, thus forming a multi-layer knit structure where one layer has more courses than the other layer to provide the self-elevating tubular knit structure (as described in more detail below). In certain embodiments, the raised structures 110 may be raised at least about 2 mm relative to the base portion 104, such as about 4 mm in certain exemplary embodiments. The raised structures 110 may each include approximately the same elevation, or at least some of the raised structures 110 may have different elevations than others. While any suitable length is contemplated, the raised structures 110 of the depicted embodiment may have length of at least about 5 mm, such as about 10 mm. Desirable lengths of the raised structures 110 may be determined by the types of manufacturing techniques used (e.g., the knitting sequence(s) as described in more detail below), and/or by the desired physical and/or aesthetic characteristics of the knitted component 102.

Figure 3:
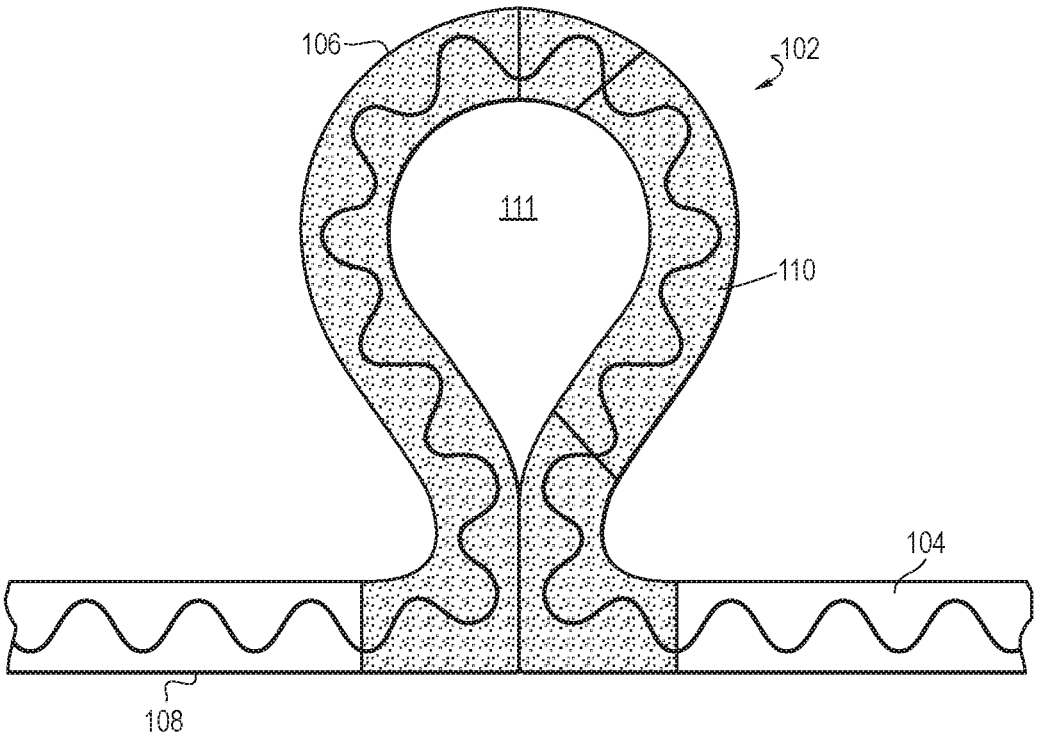
FIG. 3 is an illustration showing a side view of a tubular knit structure forming a raised structure in accordance with certain aspects of the present disclosure.
Figure 9:
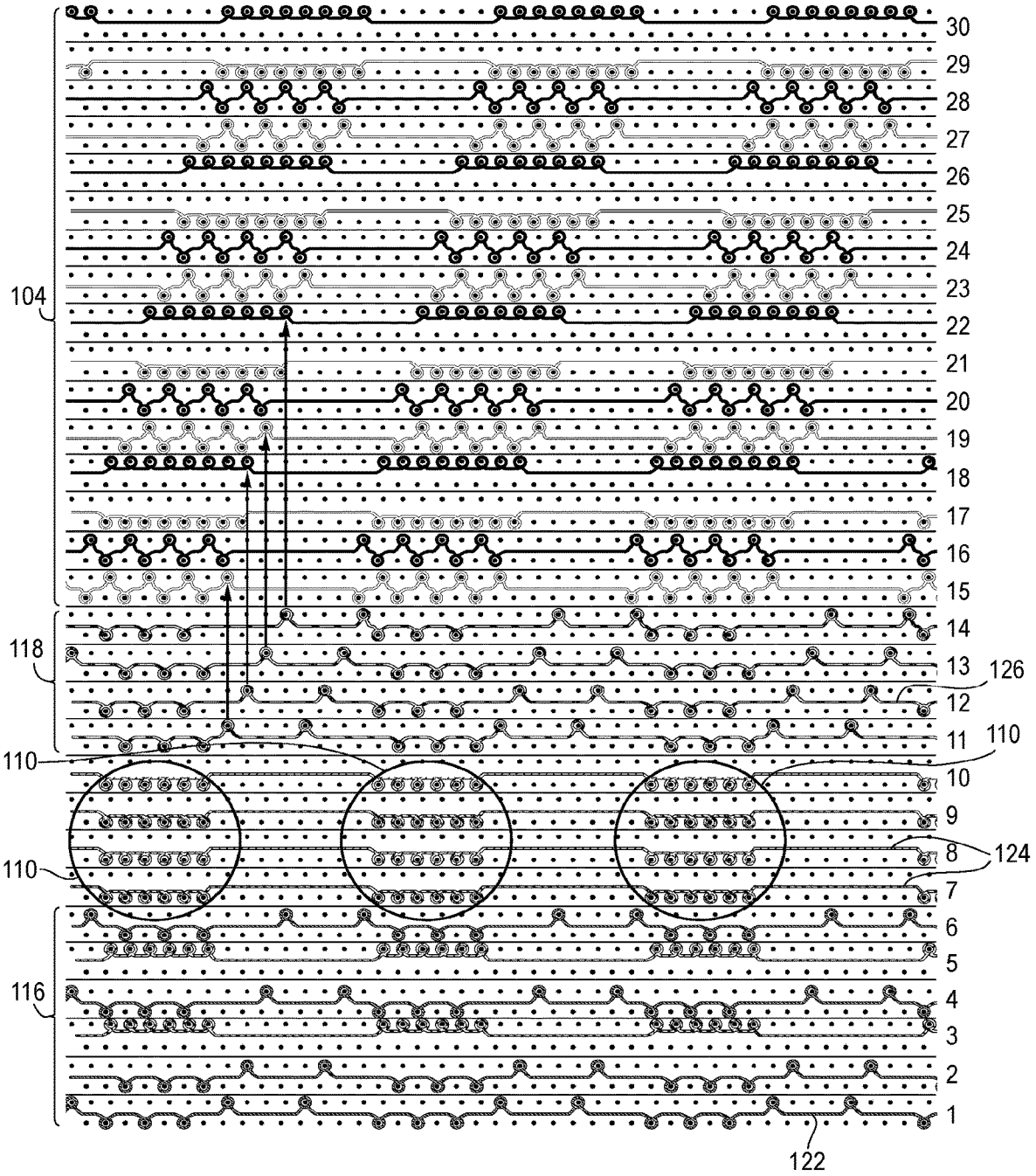
FIG. 9 is a diagram showing a potential knitting sequence for forming a knitted component having an angled raised structure in accordance with certain aspects of the present disclosure.

Referring to FIG. 3, which is an illustration showing a side view of an example of a raised structure 110, the raised structure 110 may be generally formed with a knitting technique that forms a tubular knit structure, such as a technique where a number of courses are formed on a single needle bed of the knitting machine alone without knitting on the second needle bed (see, e.g., the raised structure 110 indicated in the knit diagram of FIG. 9). The raised structure 110 may therefore comprise more courses and/or more loops on a first side 106 of the knitted component 102 relative to the number of courses and/or loops on the second side 108, the therefore the raised structure 110 has a tendency to elevate from the first side 106 relative to the surrounding base portion 104. The first side 106 and the second side 108 may include separable layers at the raised structure 110 due to the tubular structure, and thus the raised structure 110 may have an opening or pocket 111 therein located between the first side 106 and the second side 108, which optionally may be filled with another component (e.g., a non-knit component supplied after knitting).

Figure 4:
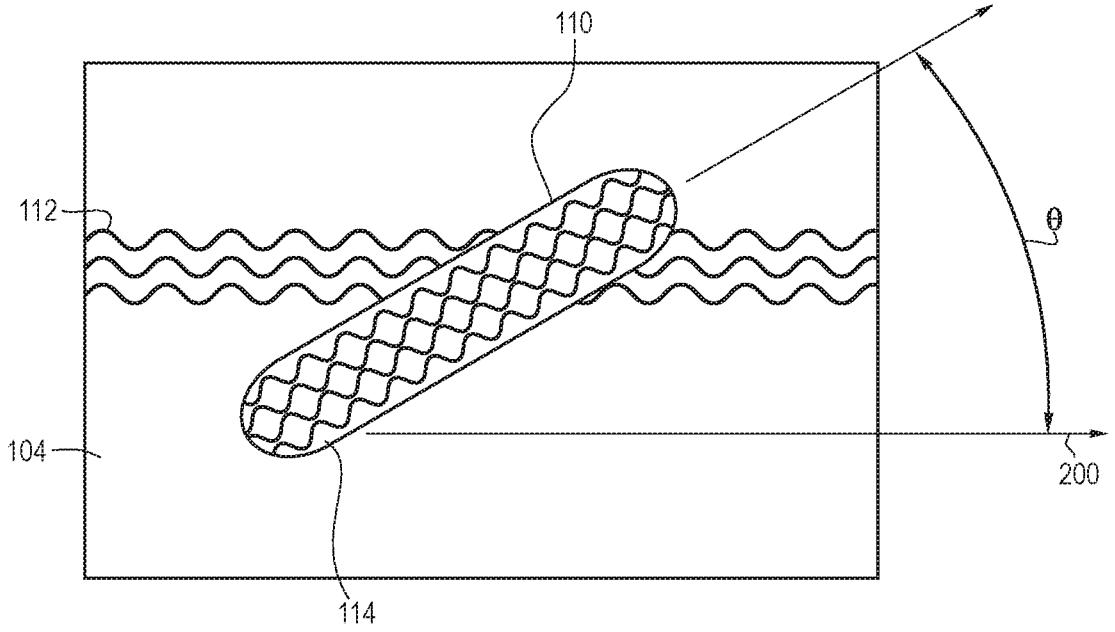
FIG. 4 is an illustration showing an angled raised structure, including angled raised structure courses, that is angled with respect to a course-wise direction of the knitted component in accordance with certain aspects of the present disclosure.

Typically, a tubular knit structure is an elongated feature that extends lengthwise in the course-wise direction 200. However, as described herein, the presently-described raised structures 110 may be angled with respect to the course-wise direction 200. That is, the longitudinal axis 206 of the raised structure 110, may be angled with respect to the course-wise direction 200 (at a depicted angle θ, for example). To illustrate, FIG. 4 depicts a set of base courses 112 forming the base portion 104 and a set of angled raised structure courses 114 forming the raised structure 110 (e.g., four raised structure courses 114 that are interlooped). As shown, the raised structure courses 114, which each include a plurality of uninterrupted consecutive loops (e.g., formed on a single needle bed in accordance with the tubular knit structure described above), may be angled at least 5 degrees relative to the course-wise direction 200 (which is approximately, or exactly, the lengthwise direction of the base courses 112), at least 10 degrees relative to the course-wise direction 200, at least 20 degrees relative to the course-wise direction, or more. Specific techniques for forming an angled raised structure 110 are described herein (e.g., with reference to FIG. 5). Advantages of the angled raised structures 110 include, but are not limited to, desirable aesthetics, particular friction characteristics (e.g., the textile may provide surface friction in particular, select directions based on the angled orientation and size of the raised structures 110), etc.

Figure 5:
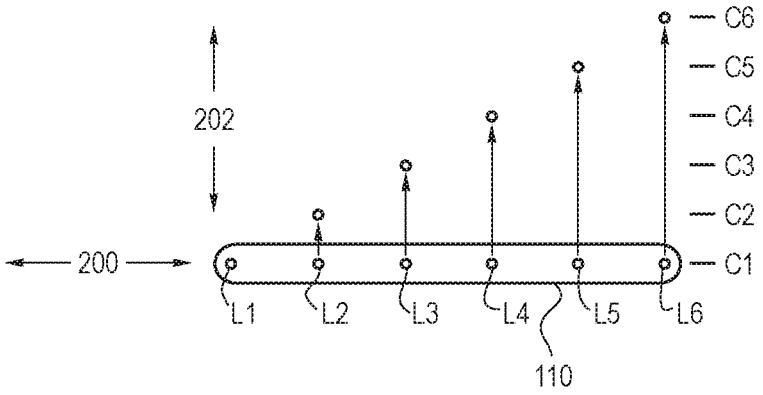
FIG. 5 is an illustration showing a knitting technique, including selectively holding loops coupled to the raised structure for a select period of time, for manufacturing an angled raised structure in accordance with certain aspects of the present disclosure.
Figure 6:
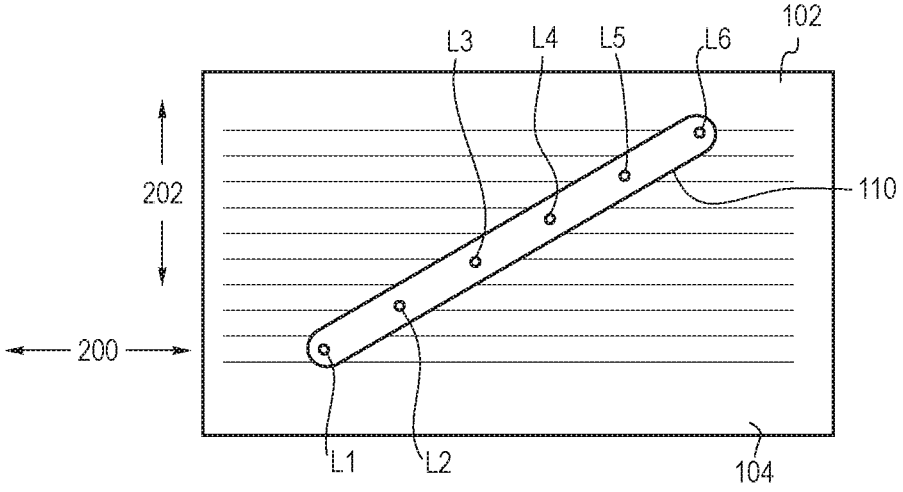
FIG. 6 is an illustration showing an angled raised structure manufacturing in accordance with the technique illustrated in FIG. 5.

FIG. 5 is an illustration showing a technique for manufacturing the knitted component 102 with the angled raised structures 110, and FIG. 6 shows the raised structure 110 after completion of the process of FIG. 5. Referring to FIG. 5, the raised structure 110 is depicted as a tubular knit structure as it may appear immediately after formation on a knitting machine (e.g., after its courses are coupled to both needle beds to close the "tube"). As shown, in this instant, the longitudinal axis of the tubular knit structure may be parallel to the course-wise direction 200. The raised structure 110 may be secured to the base portion (not shown) with a plurality of loops, which are represented in FIGS. 5-6 as loops L1, L2, L3, L4, L5, and L6 (although any suitable number of loops may be used to secure the raised structure to the base portion 104. The loops L1-L6 may all be part of the same course, but this is not required, and in some embodiments, a high tenacity yarn may be used to form the loops L1-L6 to provide sufficient strength (as described in more detail below). Further, the loops L1-L6 not be directly behind the tubular knit structure, but instead may be offset with respect to loops of the tubular knit structure such that they indirectly force the tubular knit structure into an angled orientation even when partially offset from the tubular knit structure through yarn tension (e.g., as is accomplished by the knitted structure of the knit diagram depicted by FIG. 9).

Still referring to FIG. 5, the raised structure 110 may be angled relative to the course-wise direction 200 by selectively releasing the loops L1-L6 at different points (e.g., at different courses such that they are offset in the wale-wise direction 202) during the knitting process. For example, loop L1 may be released at a first course C1, which may be a course that occurs immediately after finalizing the tubular knit structure forming the raised structure 110. The second loop L2 may be held on a needle of the knitting machine until course C2 is formed, which may occur after the course C1 is formed. As a result, the loop C2 becomes offset in the wale-wise direction 202 in the finished knit product (e.g., offset vertically in FIGS. 5-6). Similarly, loops L3-L6 may be selectively released at different respective courses C3-C6 such that the raised structure 110 is angled along its entire length, resulting in the angled raised structure 110 depicted in FIG. 6.

Figure 7:
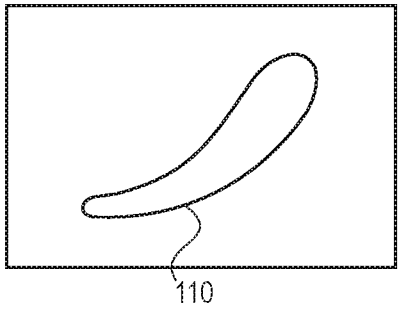
FIG. 7 is an illustration showing a curved raised structure in accordance with certain aspects of the present disclosure.

The specific angle of the raised structure 110 may be determined by the number of courses formed between when the loops L1-L6 are released. For example, if one course is formed between when each of the loops L1-L6 is released, the angle of the raised structure 110 relative to the course-wise direction 200 will be smaller than if two course are formed between each loop-release step. Further, it is contemplated that different numbers of courses may be knit/formed between the respective loops L1-L6, and thus the angle of the raised structure 110 may vary along its length. Releasing the loops L1-L6 at variable intervals may additionally cause the raised structure to curve in some instances, which is depicted in FIG. 7.

Figure 8:
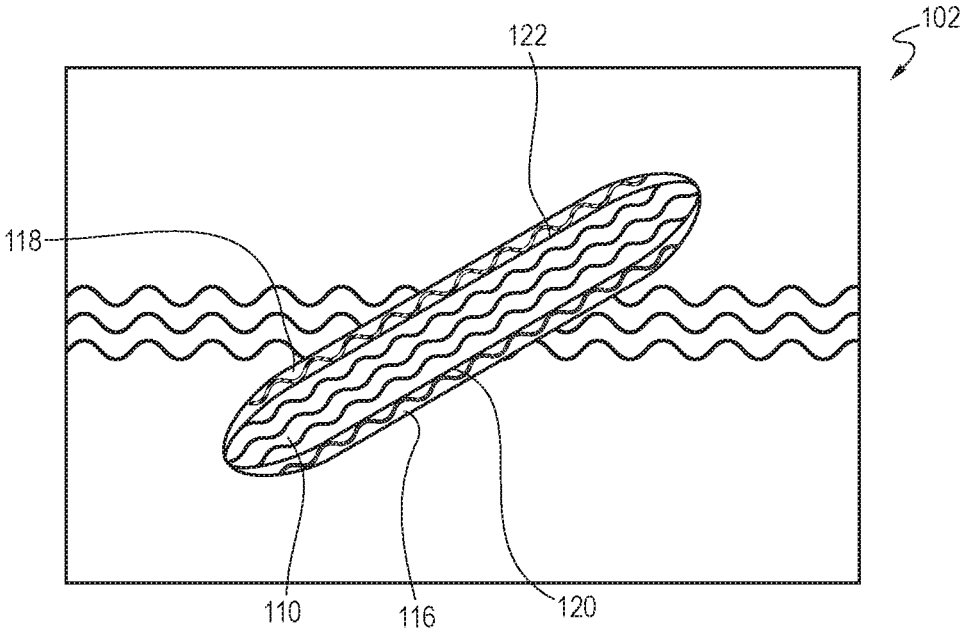
FIG. 8 is an illustration showing an angled raised structure along with a first margin and a second margin extending along longitudinal edges of the raised structure in accordance with certain aspects of the present disclosure.

In some embodiments, high-strength and/or visually-appealing margins may be included on at least one side of the raised structure 110, and such margins may form the loops L1-L6. FIG. 8 is an illustration showing a first margin 116 extending along a first edge 120 of the raised structure 110 and a second margin 118 extending along a second edge 122 of the raised structure 110, where the edges 120, 122 extend longitudinally along the raised structure 110. The margins 116, 118 may be flush (e.g., not substantially elevated) with the base portion 104 of the knitted component 102, and it is contemplated that they may be slightly depressed with respect to the base portion 104 (e.g., such that cavities are formed at the bottom of the raised structure 110). Such a depression feature may enhance the definition of the raised structures 110, for example. Further, it is contemplated that at least one of the margins 116, 118 may have a color that is different than a color of the raised structure 110, and/or different than a color of the base portion 104, which may provide desirable aesthetic effects. When two margins 116, 118 are included, the two margins 116, 118 may have the same color, or not.

The margins 116, 118 may be formed with yarns that are different than the yarns forming the raised structure 110. For example, in some embodiments, the yarns forming the raised structure 110 may be formed primarily or entirely of polyester (e.g., a strand or multiple strands of textured polyester). This may be advantageous for the desirable softness, durability, and texture characteristics provided by polyester (e.g., when the knitted component 102 is used in an article of apparel or an upper for an article of footwear).

At least one of the yarns incorporated into the margins 116, 118 may be what is referred to as a "high-tenacity" yarn, which may be particularly advantageous when it is desired for the margins to exhibit enhanced strength. For example, the loop-holding process described above (e.g., holding the loops L1-L6 of FIGS. 5-6 on the needle bed for a series of courses) may require enhanced strength relative to typically-used yarns to prevent yarn breakages during knitting. As used herein, "tenacity" is understood to refer to the amount of force (expressed in units of weight, for example: pounds, grams, centinewtons or other units) needed to rupture a yarn (i.e., the breaking force or breaking point of the yarn), divided by the linear mass density of the yarn expressed, for example, in (unstrained) denier, decitex, or some other measure of weight per unit length. The amount of force needed to break a yarn (the "breaking force" of the yarn) is determined by subjecting a sample of the yarn to a known amount of force by stretching the sample until it breaks, for example, by inserting each end of a sample of the yarn into the grips on the measuring arms of an extensometer, subjecting the sample to a stretching force, and measuring the force required to break the sample using a strain gauge load cell. Suitable testing systems can be obtained from Instron (Norwood, MA, USA). Yarn tenacity and yarn breaking force are distinct from burst strength or bursting strength of a textile, which is a measure of the maximum force that can be applied to the surface of a textile before the surface bursts.

Generally, in order for a yarn to withstand the forces applied in an industrial knitting machine, the minimum tenacity required is approximately 1.5 grams per denier (g/D). Most synthetic polymer continuous filament yarns formed from commodity polymeric materials generally have tenacities in the range of about 1.5 g/D to about 4 g/D. For example, polyester filament yarns that may be used in the manufacture of knit uppers for article of footwear have tenacities in the range of about 2.5 g/D to about 4 g/D. Filament yarns formed from commodity synthetic polymeric materials which are considered to have high tenacities (e.g., a "high tenacity yarn") generally have tenacities in the range of about 5 g/D to about 10 g/D. For example, commercially available package dyed polyethylene terephthalate filament yarn from National Spinning (Washington, NC, USA) has a tenacity of about 6 g/D, and commercially available solution dyed polyethylene terephthalate filament yarn from Far Eastern New Century (Taipei, Taiwan) has a tenacity of about 7 g/D. Filament yarns formed from high performance synthetic polymer materials generally have tenacities of about 11 g/D or greater. For example, filament yarns formed of aramid typically have tenacities of about 20 g/D, and filament yarns formed of ultra-high molecular weight polyethylene (UHMWPE) having tenacities greater than 30 g/D are available from Dyneema (Stanley, NC, USA) and Spectra (Honeywell-Spectra, Colonial Heights, VA, USA).

FIG. 9 is a diagram illustrating an example of a knitting sequence for forming the angled raised structure 110 described above, along with a first margin 116 and a second margin 118. As shown, courses 1-6 may correspond with a first margin 116. For example, a first yarn 122 of the first margin 116 may be a high-tenacity yarn as described above, having a tenacity of at least 5 g/D (such as at least 10 g/D). In the first margin 116, the first yarn 122 may be formed with three loops knitted on a front needle bed (at half-gauge) followed by two loops knitted on a back needle bed (spaced by three needles). Two passes of a second yarn 124, which may be a polyester yarn that eventually forms the raised structures (as described above), may be integrated into the first margin 116 on the back needle bed, which may provide a backing on the second side of the knitted component 102.

Referring to courses 7-10 of FIG. 9, four courses of tubular knitting (e.g., front bed only) with the second (polyester) yarn 124 may be performed to form the first side 106 (FIG. 3) of the raised structures 110. More or less than four courses of tubular knitting are contemplated, but four course may be used with a particular machine setup to obtain raised structures 110 that are elevated about 3 mm from the base portion 104. Further, each of the raised structures 110 includes six uninterrupted consecutive loops, which are optionally at full gauge on the needle bed (as shown).

Courses 11-14 of FIG. 9 form the second margin 118. As shown the structure of the second margin 118 is similar to the structure of the first margin 116, and the third yarn 126 used to form the second margin 118 may be a high-tenacity yarn. Further, the third yarn 126 may have a different color than at least one of the first yarn and/or the second yarn. In other embodiments, the third yarn 126 may be identical (and even the same strand) as the first yarn 122.

Notably, the loops 130 referenced in FIG. 9, which are on the back bed, are held on the back bed while the tubular portion of the raised structure 110 is formed. These loops 130 serve as connection points to the back bed of the knitting machine, and holding these loops on the back bed for a number of courses (e.g., as indicated by the lines 132) to force the raised structures 110 to angle (in a manner similar to as described with reference to FIG. 5, though the loops are offset in the course-wise direction from loops of a corresponding raised structure 110).

Courses 15-30 are associated with base portion 104 of the knitted component 102. These courses formed a so-called "tubular interlock" structure recognized by those skilled in the art. However, any other suitable base structure may be used in other embodiments. The yarns forming the base portion 104 may include any suitable material, such as a high-tenacity material, a polyester, a fusible material, etc. In some embodiments, for example, the base portion 104 may be formed primarily with polyester yarns, which may be desirable in articles of apparel and/or uppers for an article of footwear.

The knit sequence of FIG. 9 may be repeated, as necessary, to form a knitted component with a suitable size. Further, it is noted that the sequence(s) may be varied to incorporate different features by changing certain knit structures, by varying yarn types, by increasing or decreasing the number of courses at each step, or by any other suitable adjustment to the knitting process or materials used. Further, other sequences may be used before, after, or between the sequences of FIG. 9.

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

What is claimed is:

1. A knitted component, comprising:

a base portion;

a tubular knit structure forming a raised structure located on a first side of the base portion, the raised structure including a first yarn, wherein the raised structure is angled at least 5 degrees relative to a course-wise direction of the knitted component; and a first margin extending along a first longitudinal edge of the raised structure, wherein the first margin includes a second yarn that is different than the first yarn, and wherein the first margin is depressed relative to the base portion to form a depressed first margin.

2. The knitted component of claim 1, further comprising a second margin extending along a second longitudinal edge of the raised structure.

3. The knitted component of claim 1, wherein the depressed first margin forms a cavity at a bottom of the raised structure.

4. The knitted component of claim 2, wherein the second margin is depressed relative to the base portion to form a depressed second margin.

5. The knitted component of claim 4, wherein the depressed second margin forms a cavity at the bottom of the raised structure.

6. The knitted component of claim 2, wherein the second margin includes a yarn different from the first yarn.

7. The knitted component of claim 1, wherein the first margin is a different color than the raised structure.

8. The knitted component of claim 2, wherein the second margin is a different color than the raised structure.

9. The knitted component of claim 2, wherein the second margin is a same color as the first margin.

10. The knitted component of claim 9, wherein the first margin and the second margin are a first color and the raised structure is a second color.

11. The knitted component of claim 2, wherein the first margin is a first color and the second margin is a second color.

12. A knitted component, comprising:

a base portion;

a tubular knit structure forming a raised structure located on a first side of the base portion, the raised structure including a first yarn, wherein the raised structure comprises a plurality of angled raised structure courses that are angled relative to a course-wise direction of the knitted component; and a first margin extending along a first longitudinal edge of the raised structure, wherein the first margin includes a second yarn that is different than the first yarn, wherein the first margin is depressed relative to the base portion to form a depressed first margin, and wherein the second yarn has a tenacity of at least about 5 g/D.

13. The knitted component of claim 12, wherein the second yarn is a filament yarn formed from synthetic polymeric materials.

14. The knitted component of claim 12, wherein the first yarn has a tenacity range different from the tenacity range of the second yarn.

15. The knitted component of claim 13, wherein the second yarn has a minimum tenacity of 11 g/D.

16. The knitted component of claim 12, wherein the depressed first margin forms a cavity at a bottom of the raised structure.

17. The knitted component of claim 12, further comprising a second margin extending along a second longitudinal edge of the raised structure.

18. The knitted component of claim 17, wherein the second margin is depressed relative to the base portion to form a depressed second margin.

19. The knitted component of claim 18, wherein the depressed second margin forms a cavity at the bottom of the raised structure.

20. An article of footwear, comprising:

a knitted component, comprising:

a base portion;

a tubular knit structure forming a raised structure located on a first side of the base portion, the raised structure including a first yarn, wherein the raised structure is angled at least 5 degrees relative to a course-wise direction of the knitted component; and a first margin extending along a first longitudinal edge of the raised structure, wherein the first margin includes a second yarn that is different than the first yarn, and wherein the first margin is depressed relative to the base portion.

* * * * *